US010215471B2

(12) United States Patent
Grimm et al.

(10) Patent No.: US 10,215,471 B2
(45) Date of Patent: Feb. 26, 2019

(54) STRUCTURAL STANCHION FOR A CABINET OF AN APPLIANCE

(71) Applicant: WHIRLPOOL CORPORATION, Benton Harbor, MI (US)

(72) Inventors: Brian Grimm, Williamsburg, IA (US); Jeremiah S. Papke, North Liberty, IA (US); Axel Julio Ramm, St. Joseph, MI (US); Gerald S. Szczech, Coralville, IA (US); Geraldo Luiz Thomaz, Coralville, IA (US); Scott M. Wesbrook, Cedar Rapids, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 3 days.

(21) Appl. No.: 15/051,142

(22) Filed: Feb. 23, 2016

(65) Prior Publication Data

US 2017/0184341 A1 Jun. 29, 2017

Related U.S. Application Data

(60) Provisional application No. 62/271,399, filed on Dec. 28, 2015.

(51) Int. Cl.

| | |
|---|---|
| ***A47B 96/04*** | (2006.01) |
| ***F25D 21/04*** | (2006.01) |
| ***F25D 23/06*** | (2006.01) |

(52) U.S. Cl.

CPC ..... *F25D 21/04* (2013.01); *F25D 23/063* (2013.01); *F25D 2323/0011* (2013.01);

(Continued)

(58) Field of Classification Search

CPC ..... F25D 23/067; F25D 23/028; F25D 23/04; F25D 25/025; F25D 2323/0011; F25D 2323/021; F25D 2323/024; F25D 2400/02; F25D 2400/04; F25D 21/04; F25D 2400/06; F25D 23/069; F25D 23/065

(Continued)

(56) References Cited

U.S. PATENT DOCUMENTS 3,632,012 A * 1/1972 Kitson ..... F25D 23/064 220/592.06

3,835,660 A 9/1974 Franck (Continued)

FOREIGN PATENT DOCUMENTS

| | | |
|---|---|---|
| CN | 201377956 | 1/2010 |
| CN | 102192634 | 9/2011 |

(Continued)

*Primary Examiner* — Daniel J Troy
*Assistant Examiner* — Timothy M Ayres
(74) *Attorney, Agent, or Firm* — Price Heneveld LLP

(57) ABSTRACT

An appliance includes a cabinet having first and second sidewalls and an interior mullion extending therebetween, wherein the first and second sidewalls and the interior mullion define a plurality of interior compartments. First and second stanchions define vertical structural members of the first and second sidewalls, respectively. The first stanchion includes a first medial flange that extends partially into the interior mullion. The first medial flange defines a first hinge attachment point, and a distal end of the first medial flange is positioned proximate a first hinge.

16 Claims, 14 Drawing Sheets

(52) U.S. Cl.
CPC .. *F25D 2323/021* (2013.01); *F25D 2323/024* (2013.01); *F25D 2400/04* (2013.01)

(58) Field of Classification Search
USPC ..... 312/401
See application file for complete search history.

(56) References Cited

U.S. PATENT DOCUMENTS

| | | | | | |
|---|---|---|---|---|---|
| 3,984,223 | A | | 10/1976 | Whistler, Jr. | |
| 4,150,518 | A | | 4/1979 | Truesdell et al. | |
| 4,170,391 | A | * | 10/1979 | Bottger | E05D 3/04 248/222.11 |
| 4,190,305 | A | * | 2/1980 | Knight | E04H 5/10 220/592.1 |
| 4,548,049 | A | * | 10/1985 | Rajgopal | F25D 21/04 62/248 |
| 4,550,576 | A | | 11/1985 | Tate, Jr. et al. | |
| 4,557,537 | A | * | 12/1985 | Greer | H01R 4/64 29/256 |
| 4,558,503 | A | * | 12/1985 | Wilson | B23P 15/26 29/446 |
| 4,632,470 | A | * | 12/1986 | Jenkins | F25D 23/062 29/525.12 |
| 4,765,696 | A | | 8/1988 | Cordill et al. | |
| 4,822,117 | A | * | 4/1989 | Boston, Jr. | F25D 23/062 29/455.1 |
| 5,052,151 | A | | 10/1991 | Inui | |
| 5,064,255 | A | | 11/1991 | Inui et al. | |
| 5,222,792 | A | | 6/1993 | Kai et al. | |
| 5,255,531 | A | | 10/1993 | Williams et al. | |
| 5,349,832 | A | * | 9/1994 | Johnson | E05D 5/06 312/407 |
| 5,992,960 | A | | 11/1999 | Wolanin | |
| 6,036,294 | A | * | 3/2000 | Banicevic | F25D 23/069 312/296 |
| 6,428,130 | B1 | | 8/2002 | Banicevic et al. | |
| 6,565,170 | B2 | * | 5/2003 | Banicevic | F25D 23/04 312/404 |
| 7,108,341 | B2 | | 9/2006 | Myers et al. | |
| 7,194,792 | B2 | * | 3/2007 | Grace | F25D 23/062 29/428 |
| 7,293,848 | B2 | | 11/2007 | Myers et al. | |
| 7,517,031 | B2 | | 4/2009 | Laible | |
| 7,556,227 | B2 | * | 7/2009 | Thuelig | A47L 15/4253 248/125.2 |
| 8,752,920 | B2 | | 6/2014 | Rapp | |
| 8,864,253 | B2 | * | 10/2014 | Gorz | F25D 23/064 312/406 |
| 8,887,355 | B2 | | 11/2014 | Kleemann et al. | |
| 8,979,224 | B2 | * | 3/2015 | Jang | F25D 23/069 312/407 |

FOREIGN PATENT DOCUMENTS

| | | |
|---|---|---|
| CN | 102207348 | 10/2011 |
| CN | 202153075 | 2/2012 |
| CN | 202195641 | 4/2012 |
| CN | 202209837 | 5/2012 |
| CN | 102997564 | 3/2013 |
| CN | 102997565 | 3/2013 |
| CN | 203177568 | 9/2013 |
| EP | 0206257 | 12/1986 |
| EP | 0206258 | 3/1992 |
| EP | 2557380 | 2/2013 |
| FR | 2825406 | 12/2002 |
| JP | 688669 | 3/1994 |
| JP | 6129753 | 5/1994 |
| JP | 7180944 | 7/1995 |
| JP | 1270051 | 10/1995 |
| JP | 875340 | 3/1996 |
| JP | 8313142 | 11/1996 |
| JP | 933153 | 2/1997 |
| JP | 9264656 | 10/1997 |
| JP | 102657 | 1/1998 |
| JP | 1030878 | 2/1998 |
| JP | 1038452 | 2/1998 |
| JP | 1062054 | 3/1998 |
| JP | 1096579 | 4/1998 |
| JP | 10300320 | 11/1998 |
| JP | 10318656 | 12/1998 |
| JP | 10318657 | 12/1998 |
| JP | 10339556 | 12/1998 |
| JP | 112485 | 1/1999 |
| JP | 11118327 | 4/1999 |
| JP | 11311478 | 11/1999 |
| JP | 2000046461 | 2/2000 |
| JP | 2000213853 | 8/2000 |
| JP | 2000213859 | 8/2000 |
| JP | 2002267328 | 9/2002 |
| JP | 2003172566 | 6/2003 |
| JP | 2005180720 | 7/2005 |
| JP | 2007263389 | 10/2007 |
| JP | 2013019662 | 1/2013 |
| KR | 20050001138 | 1/2005 |
| WO | 2007062924 | 6/2007 |
| WO | 2012028998 | 3/2012 |

* cited by examiner

STRUCTURAL STANCHION FOR A CABINET OF AN APPLIANCE

CROSS-REFERENCE TO RELATED APPLICATION

This application claims priority to and the benefit under 35 U.S.C. § 119(e) of U.S. Provisional Patent Application No. 62/271,399, filed on Dec. 28, 2015, entitled "STRUCTURAL STANCHION FOR A CABINET OF AN APPLIANCE," the entire disclosure of which is hereby incorporated herein by reference.

BACKGROUND

The device is in the field of kitchen appliances, and more specifically, kitchen appliances incorporating vertical structural stanchions for supporting a cabinet and containing various aspects of the cabinet of the appliance.

SUMMARY

In at least one aspect, an appliance includes a cabinet having first and second sidewalls and an interior mullion extending therebetween, wherein the first and second sidewalls and the interior mullion define a plurality of interior compartments. First and second stanchions define vertical structural members of the first and second sidewalls, respectively. The first stanchion includes a first medial flange that extends partially into the interior mullion. The first medial flange defines a first hinge attachment point, and a distal end of the first medial flange is positioned proximate a first hinge.

In at least another aspect, an appliance includes a first sidewall having a first hinge attached to a first stanchion, a second sidewall having a second hinge attached to a second stanchion and an interior mullion extending between the first and second stanchions. First and second medial flanges of the first and second stanchions, respectively, extend into the interior mullion and support the first and second hinges. A mullion cover extends along the interior mullion between the first and second medial flanges, wherein the first and second medial flanges are free of engagement with one another.

In at least another aspect, a method for forming a cabinet for an appliance includes forming an outer wrapper that defines first and second sidewalls. The first and second sidewalls each include an outer flange that defines a contact surface and an interstitial space. First and second stanchions are disposed proximate a front edge of the first and second sidewalls, respectively. The interstitial space is further defined between the first and second stanchions and the outer flange. The first and second stanchions each include a plurality of slots defined therein, and wherein the first and second stanchions define vertical supports of the first and second sidewalls. A mullion cover is disposed in engagement with first and second medial flanges of the first and second stanchions, respectively, wherein the first medial flange is free of engagement with the second medial flange. An inner liner is disposed within the outer wrapper, wherein the inner liner defines a plurality of interior compartments. Insulation material is disposed into an insulating cavity defined between the inner liner and the outer wrapper, wherein the insulation is deposited in the interstitial space via the plurality of slots. At least one operable panel is disposed in operable engagement with at least one of the first and second sidewalls, wherein the at least one operable panel selectively engages the contact surface to define a closed position of the at least one operable panel, and wherein an outer surface of the mullion cover defines a portion of the contact surface.

These and other features, advantages, and objects of the present device will be further understood and appreciated by those skilled in the art upon studying the following specification, claims, and appended drawings.

DETAILED DESCRIPTION OF EMBODIMENTS

Figure 1:
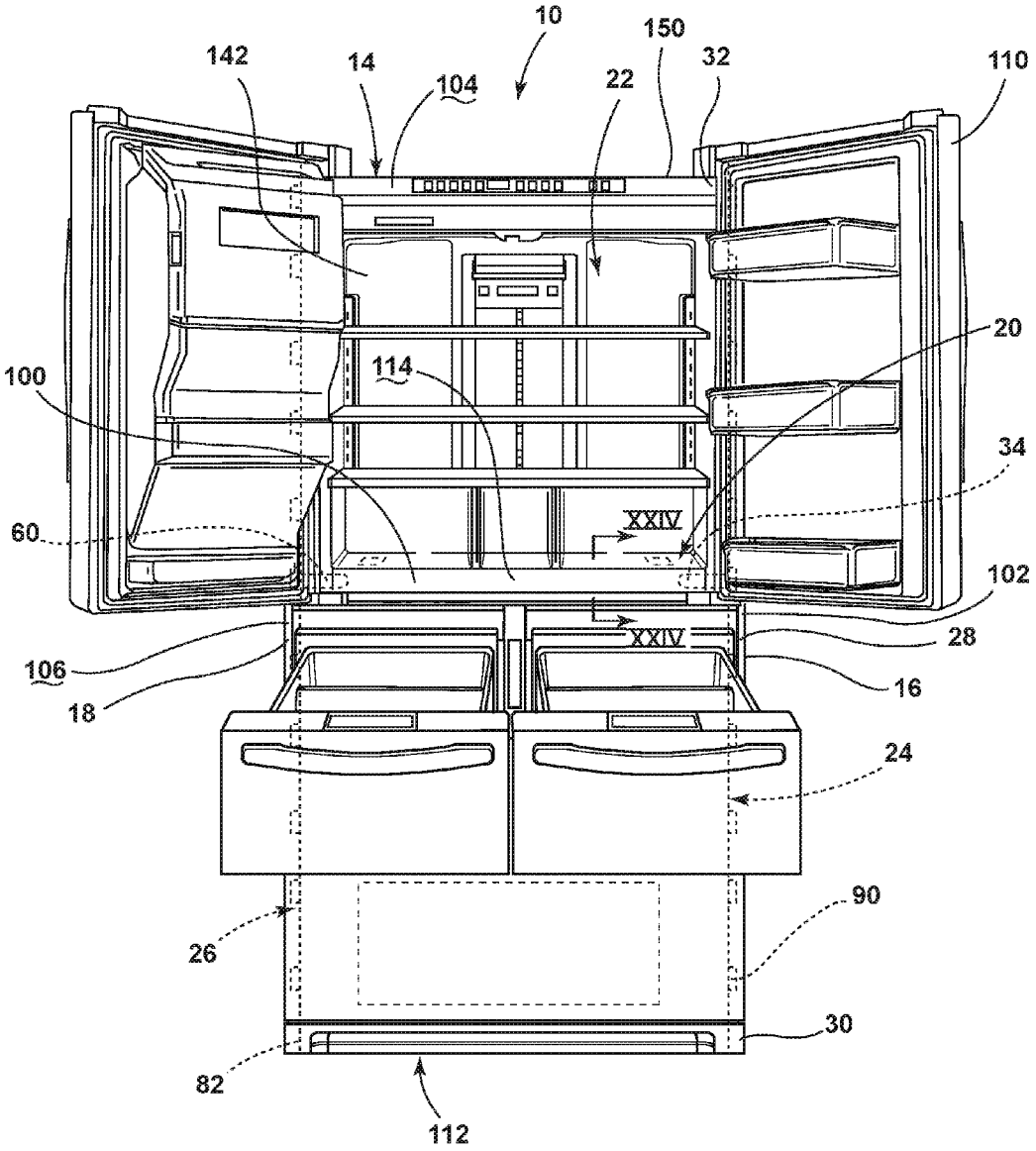
FIG. 1 is a front perspective view of an appliance incorporating an aspect of the structural stanchion.
Figure 2:
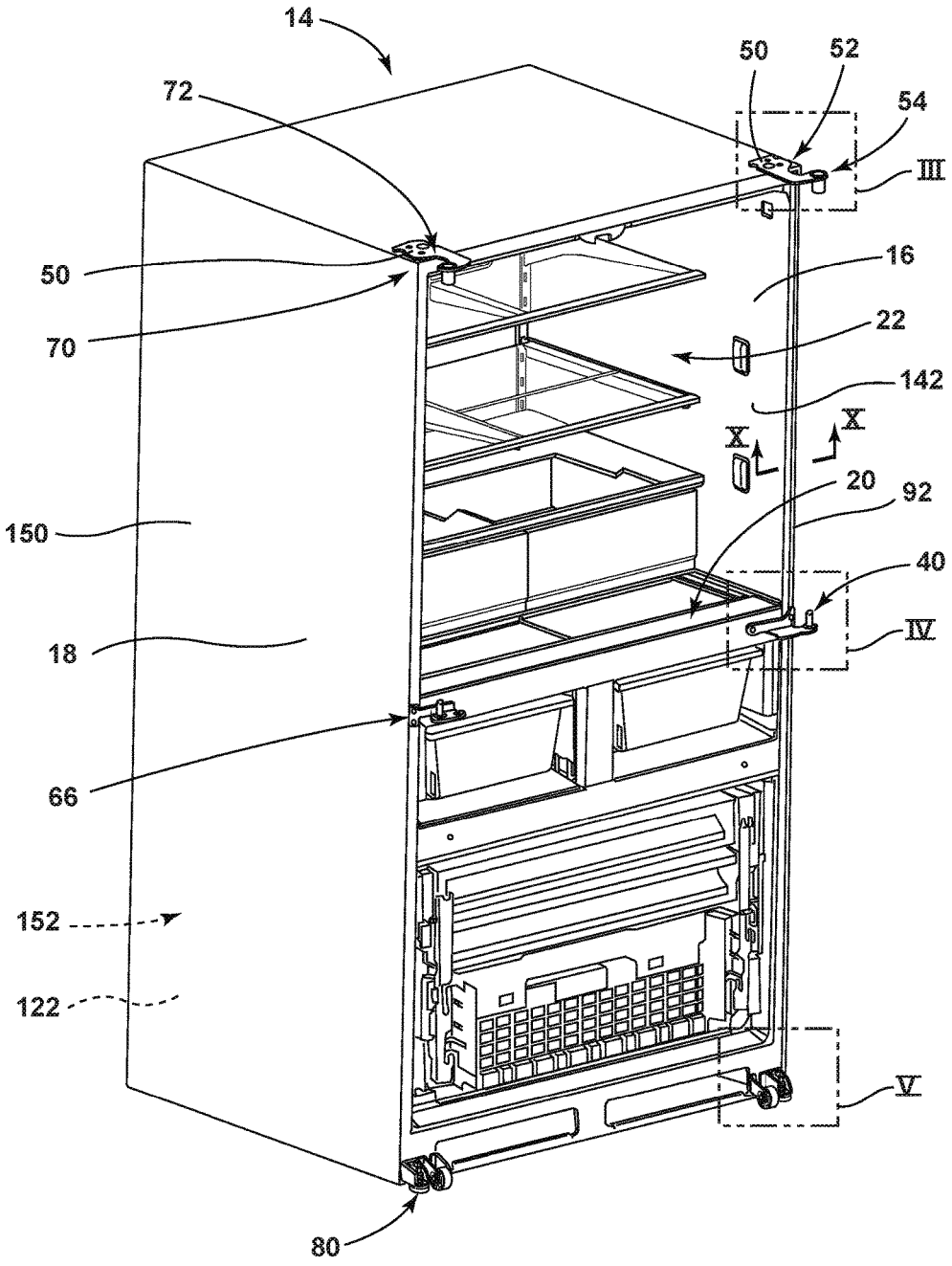
FIG. 2 is a front perspective view of an appliance incorporating an aspect of the structural stanchion with the operable panels removed.
Figure 3:
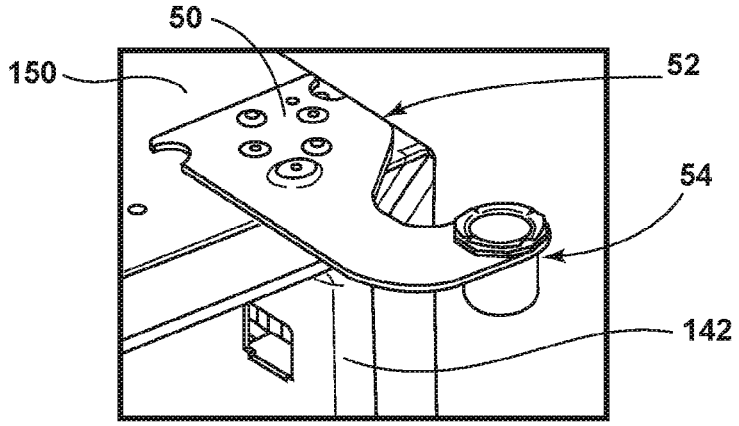
FIG. 3 is an enlarged perspective view of a top hinge of the appliance of FIG. 2 taken at area III.
Figure 4:
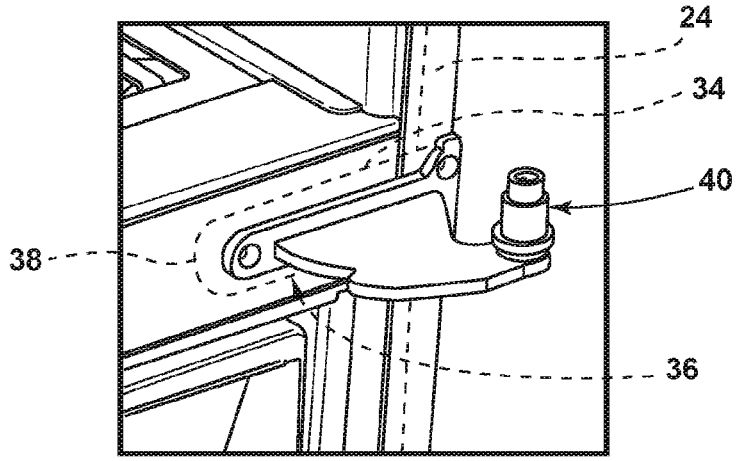
FIG. 4 is an enlarged perspective view of the appliance of FIG. 2 taken at area IV.
Figure 5:
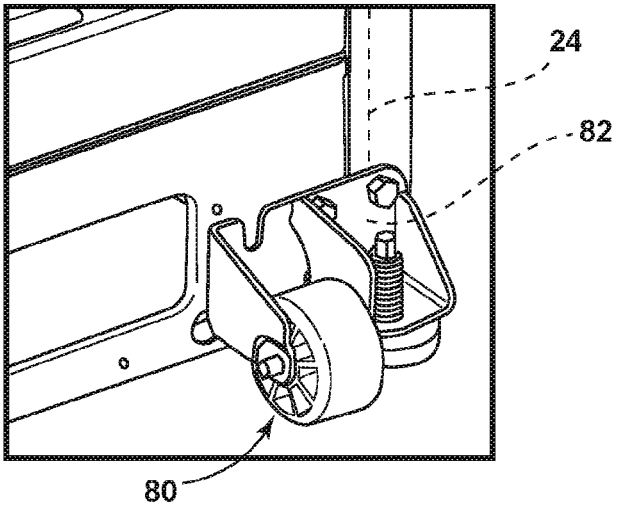
FIG. 5 is an enlarged perspective view of the appliance of FIG. 2 taken at area V.
Figure 6:
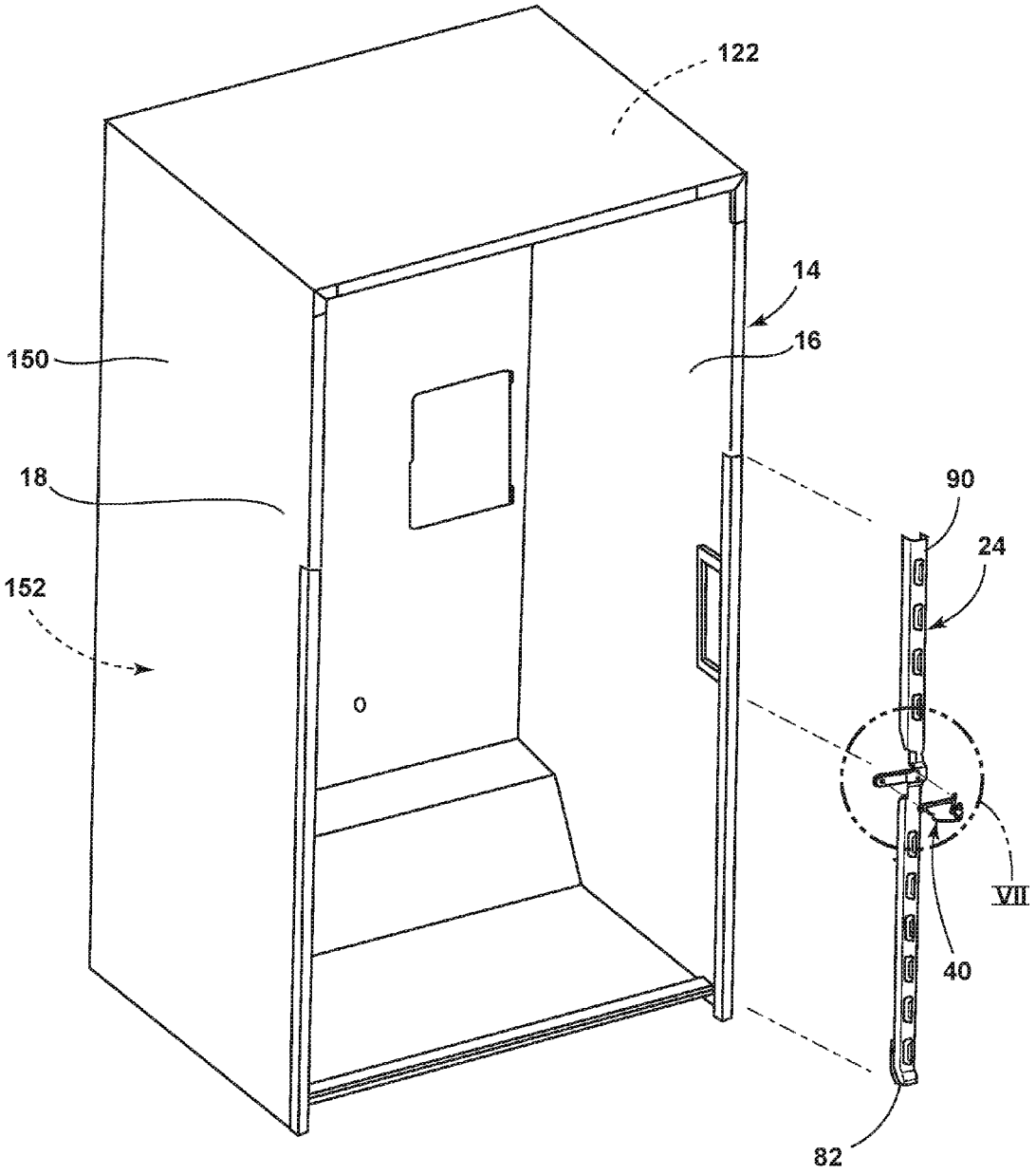
FIG. 6 is a front perspective view of a cabinet for an appliance incorporating an aspect of the structural stanchion.
Figure 7:
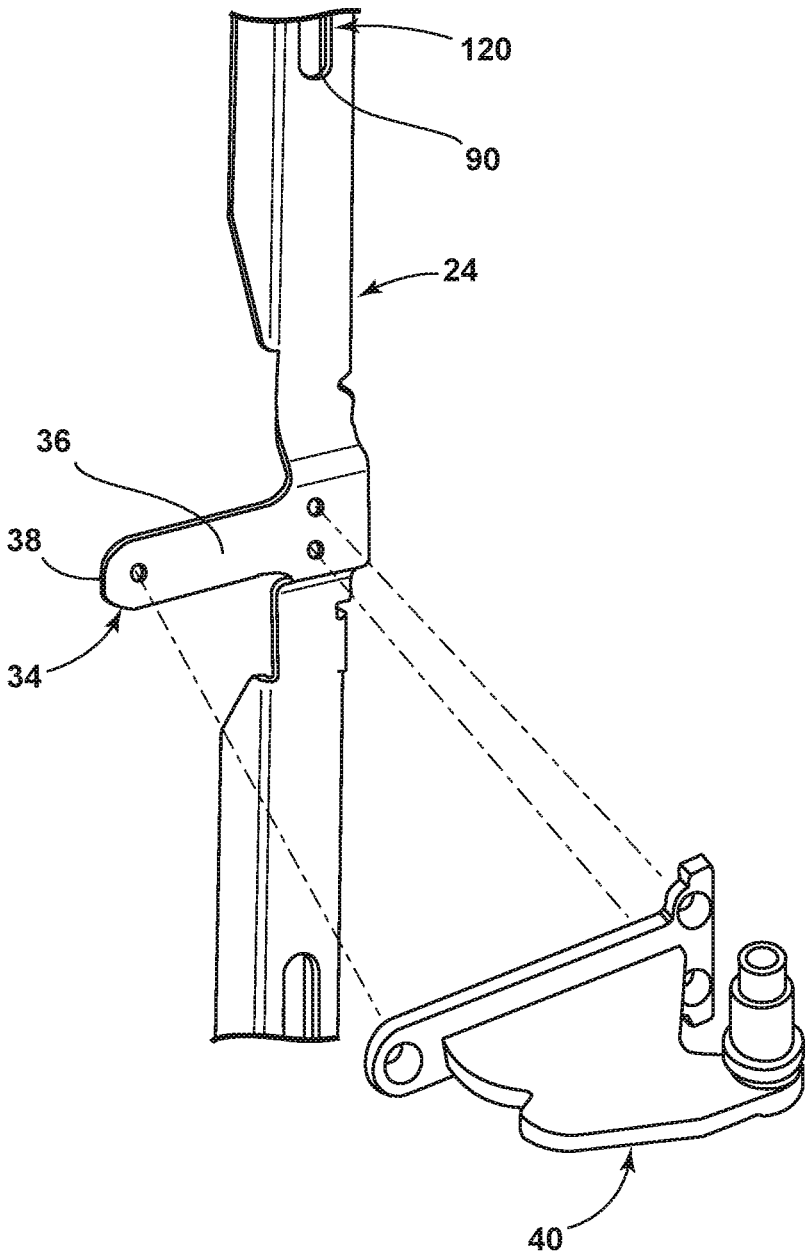
FIG. 7 is an enlarged perspective view of an aspect of the structural stanchion of FIG. 6 taken at area VII.
Figure 8:
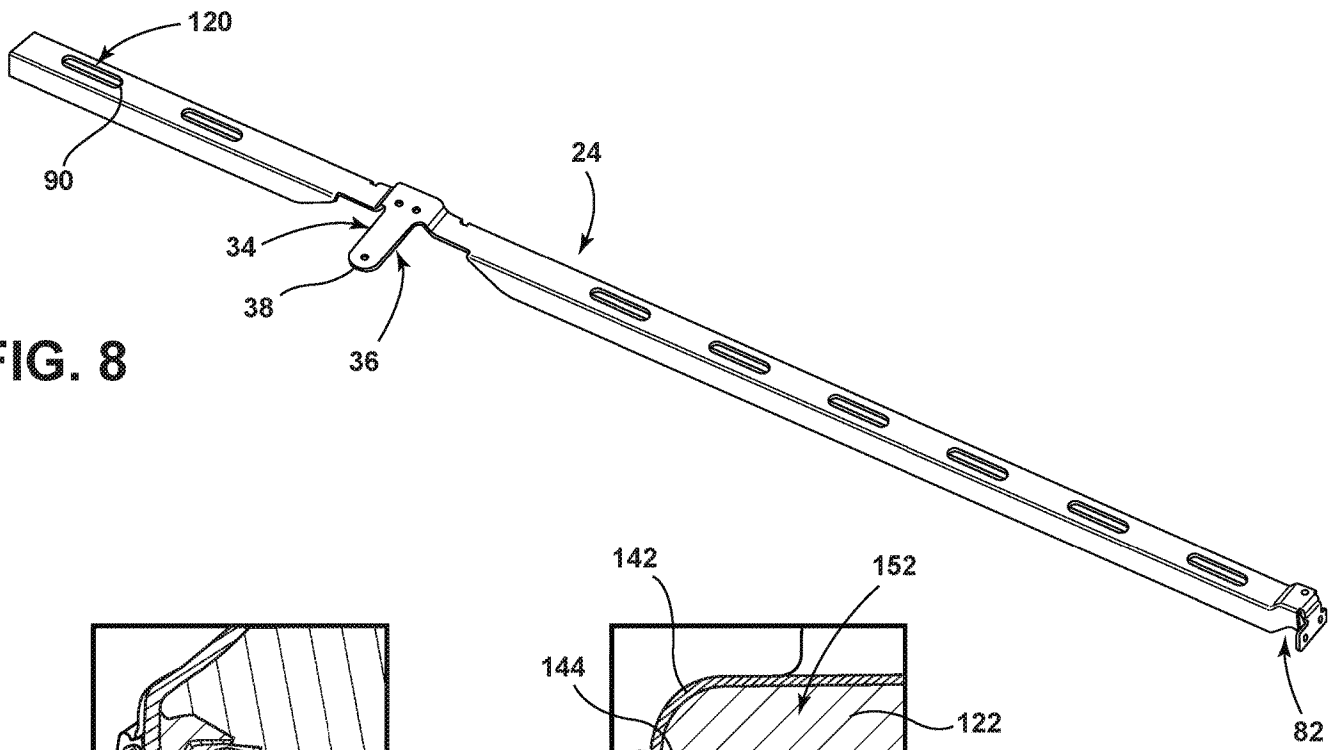
FIG. 8 is a front perspective view of an aspect of the structural stanchion.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As illustrated in FIGS. 1-8 and 10, reference numeral 10 generally refers to an appliance incorporating an aspect of a structural stanchion used to at least partially support a cabinet 14 of the appliance 10, according to various embodiments. The appliance 10 includes a cabinet 14 having first and second sidewalls 16, 18 and an interior mullion 20 extending therebetween. The first and second sidewalls 16, 18 and the interior mullion 20 define a plurality of the interior compartments 22 of the appliance 10. First and second stanchions 24, 26 that define vertical structural members of the first and second sidewalls 16, 18, respectively, are disposed at front edges 28 of the first and second sidewalls 16, 18. The first and second stanchions 24, 26 extend from a base 30 of the refrigerator, which can include a base panel and extend upward along the front edge 28 of the first and second sidewalls 16, 18. It is contemplated that the first and second stanchions 24, 26 can extend to a top panel 32 of the cabinet 14, as will be discussed more fully below. The first stanchion 24 includes a first medial flange 34 that extends partially into the interior mullion 20. Accordingly, the first medial flange 34 defines a first hinge attachment point 36 and wherein a distal end 38 of the first medial flange 34 is disposed proximate a first hinge 40. In this manner, it is contemplated that the first medial flange 34 extends far enough into the interior mullion 20 to provide a structural support for the first hinge 40 such that the distal end 38 of the first medial flange 34 extends partially past the connection points for the first hinge 40.

According to the various embodiments, as exemplified in FIGS. 1-8, 10 and 17, the first and second stanchions 24, 26 can include top flanges 50 that can be positioned proximate the top panel 32 of the cabinet 14. The top flange 50 of the first stanchion 24 can define a first upper hinge support 52 that supports a first upper hinge 54 of the appliance 10. It is contemplated that the first upper hinge 54 is vertically aligned with the first hinge 40 of the first medial flange 34.

Referring again to FIGS. 1-8 and 10, the second stanchion 26 can include a second medial flange 60 that extends partially into the interior mullion 20. It is contemplated that the second medial flange 60 can define a second hinge attachment point 62. An outer end 64 of the second medial flange 60 is positioned proximate a second hinge 66. In this manner, the distal end 38 of the first medial flange 34 is free of direct engagement with the outer end 64 of the second medial flange 60. As with the distal end 38 of the first medial flange 34, the outer end 64 of the second medial flange 60 extends enough of a distance past the second hinge 66 to provide a structural attachment for the second hinge 66. According to the various embodiments, the first and second medial flanges 34, 60 are integrally formed with the first and second stanchions 24, 26, respectively.

Referring again to FIGS. 1-8, 10 and 17, it is contemplated that top flange 50 if the first stanchion 24 can include the first upper hinge support 52. The top flange 50 of the second stanchion 26 can also define a second upper hinge support 70 that supports a second upper hinge 72. It is contemplated that the second upper hinge 72 is vertically aligned with the second hinge 66 of the second medial flange 60. The first and second stanchions 24, 26 can extend from a base 30 of the cabinet 14 to a top panel 32 of the cabinet 14. It is contemplated that a leveling mechanism 80 of the cabinet 14 is disposed proximate the base 30 and the bottom ends 82 of the first and second stanchions 24, 26. These leveling mechanisms 80 can include vertically operable feet, wheels, combinations thereof, and other mechanisms that control the vertical and lateral placement of the appliance 10 within a particular location.

Referring again to FIGS. 1-8, 10 and 17, it is contemplated that the integral formation of the first and second medial flanges 34, 60 with the first and second stanchions 24, 26 provides a sturdy structural support for the first and second hinges 40, 66. The first and second medial flanges 34, 60 also minimize the amount of material necessary for supporting the first and second hinges 40, 66. The integral nature of the first and second stanchions 24, 26 allows this additional structural support to be eliminated in the various aspects of the appliance 10 disclosed herein. The first and second medial flanges 34, 60 provide a robust hinge support for the first and second hinges 40, 66, as well as the first and second upper hinges 54, 72. The first and second stanchions 24, 26 also provide a robust support for allowing the leveling mechanism 80 at the base 30 of the appliance 10 to operate and place the appliance 10 at a level position as well as raising and lowering the appliance 10 for lateral movement of the appliance 10 in a particular location.

Referring again to FIGS. 6-8, first and second hinge attachment points 36, 62 are incorporated within the first and second medial flanges 34, 60 for connecting the first and second hinges 40, 66 to the first and second medial flanges 34, 60. It is contemplated that the first and second medial flanges 34, 60 are sized to provide a robust and structural support for the attachment points of the first and second hinges 40, 66 while limiting the distance that each of the first and second medial flanges 34, 60 extend into the interior mullion 20 of the appliance 10.

According to the various embodiments, the first and second stanchions 24, 26 can be made of a C-section or U-section metallic member that includes a plurality of slots 90 through the stanchion. The incorporation of the slots 90 decreases the amount of material used in the first and second stanchions 24, 26 and the appliance 10 as a whole. Additional functions of the slots 90 of the first and second stanchions 24, 26 will be discussed in greater detail below.

According to the various embodiments, the first and second stanchions 24, 26 can be made of various metallic materials that can include, but are not limited to, steel, aluminum, alloys thereof, combinations thereof, and other similar metallic materials.

Referring again to FIGS. 1, 2, 4, 11-14 and 24, it is contemplated that the cabinet 14 can include a mullion cover 100 that extends between the first and second stanchions 24, 26. It is contemplated that the mullion cover 100 directly engages the first and second medial flanges 34, 60. Additionally, the mullion cover 100 can extend between the first and second hinges 40, 66 and the first and second medial flanges 34, 60. The interior mullion 20 can include an interior mullion volume 96 that is at least partially defined by an inner surface 98 of the mullion cover 100. The mullion cover 100 is configured to extend over a portion of the first and second stanchions 24, 26. In particular, the mullion cover 100 extends over and at least partially engages the first and second medial flanges 34, 60. In this manner, the first and second medial flanges 34, 60 provide structural support for the mullion cover 100 and the interior mullion 20 as well. Additionally, the first and second hinges 40, 66 engage the first and second medial flanges 34, 60 and, in turn, attach to the mullion cover 100 that is positioned between the first medial flange 34 and the first hinge 40 as well as between the second medial flange 60 and the second hinge 66.

Referring again to FIGS. 1, 10 and 18-23, the appliance 10 can also include an exterior cabinet member 102, such as a triple flange 92, that extends over at least a portion of the first stanchion 24 and at least a portion of the second stanchion 26. The exterior cabinet member 102 can be a formed or shaped portion of the outer wrapper 150 that can be shaped into the triple flange 92 at least at the first and second sidewalls 16, 18. Typically, the triple flange 92 can include non-visible portion 94 that extends proximate the front edge 28 of the cabinet 14 and the first and second stanchions 24, 26, where an outward portion 104 of the triple flange 92 includes a contact surface 106. At least one operable panel 110 is operably attached to the cabinet 14, where each operable panel 110 selectively engages the contact surface 106 to define a closed position 112 of the at least one operable panel 110. It is contemplated that the outer surface 114 of the mullion cover 100 also defines at least a portion of the contact surface 106.

Figure 9:
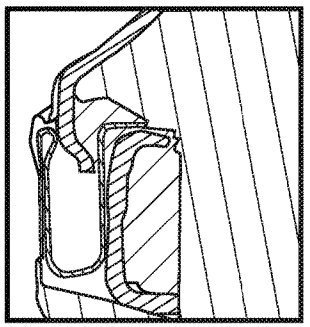
FIG. 9 (PRIOR ART)
FIG. 9 is a cross-sectional view of a prior-art design incorporating a prior-art stanchion and insulation disposed around the prior-art stanchion.
Figure 10:
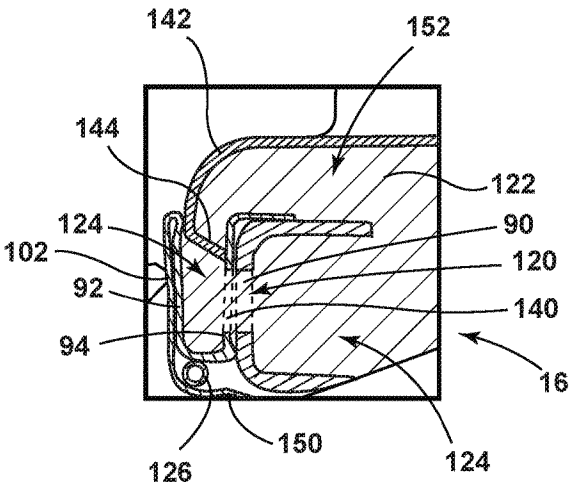
FIG. 10 is a cross-sectional view of an aspect of an appliance cabinet of FIG. 2, taken along line X-X.
Figure 12:
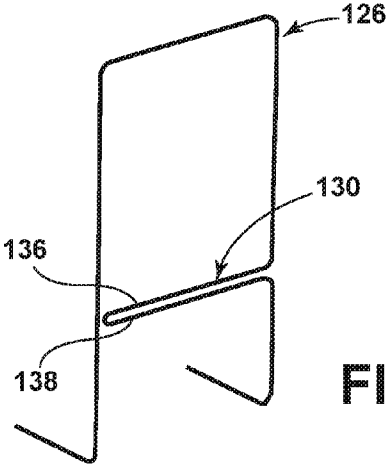
FIG. 12 is a perspective view of an aspect of a heat loop for the appliance.
Figure 13:
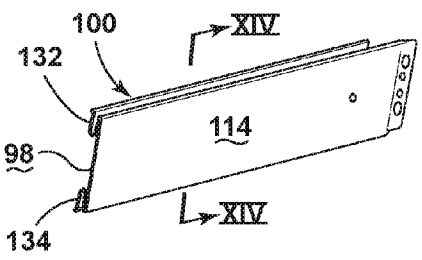
FIG. 13 is a cross-sectional perspective view of an aspect of a mullion cover of FIG. 11 taken along line XIII-XIII.
Figure 14:
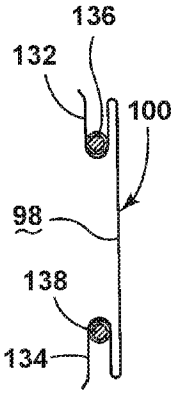
FIG. 14 is a cross-sectional view of the mullion cover of FIG. 13 taken along line XIV-XIV, and incorporating an aspect of the heat loop therein.
Figure 11:
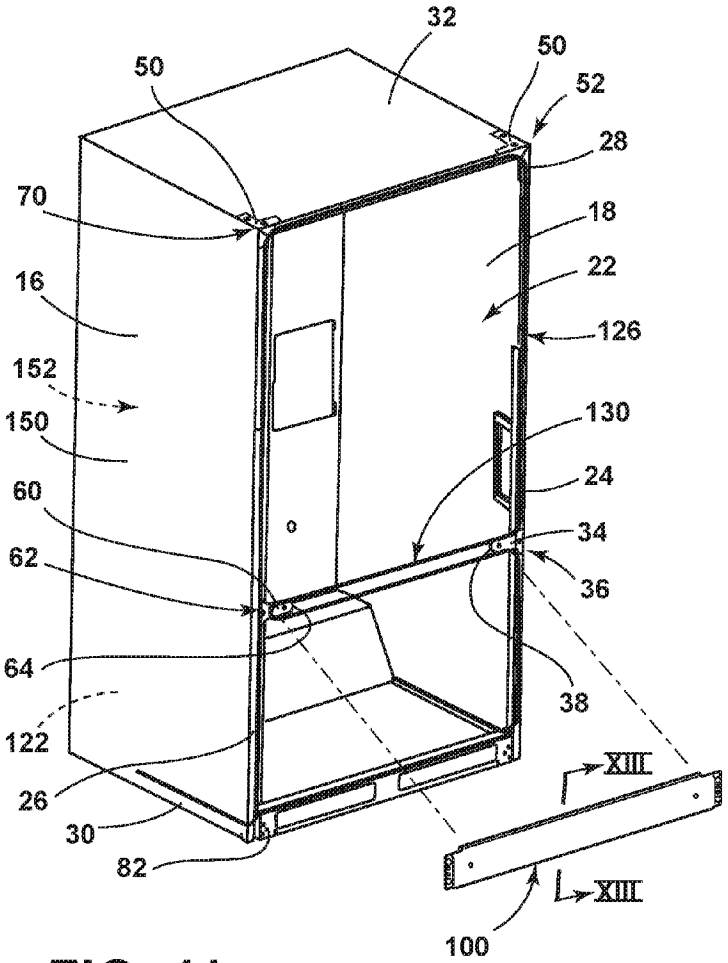
FIG. 11 is a front perspective view of an aspect of the appliance cabinet incorporating a heat loop mounted proximate the structural stanchion.
Figure 15:
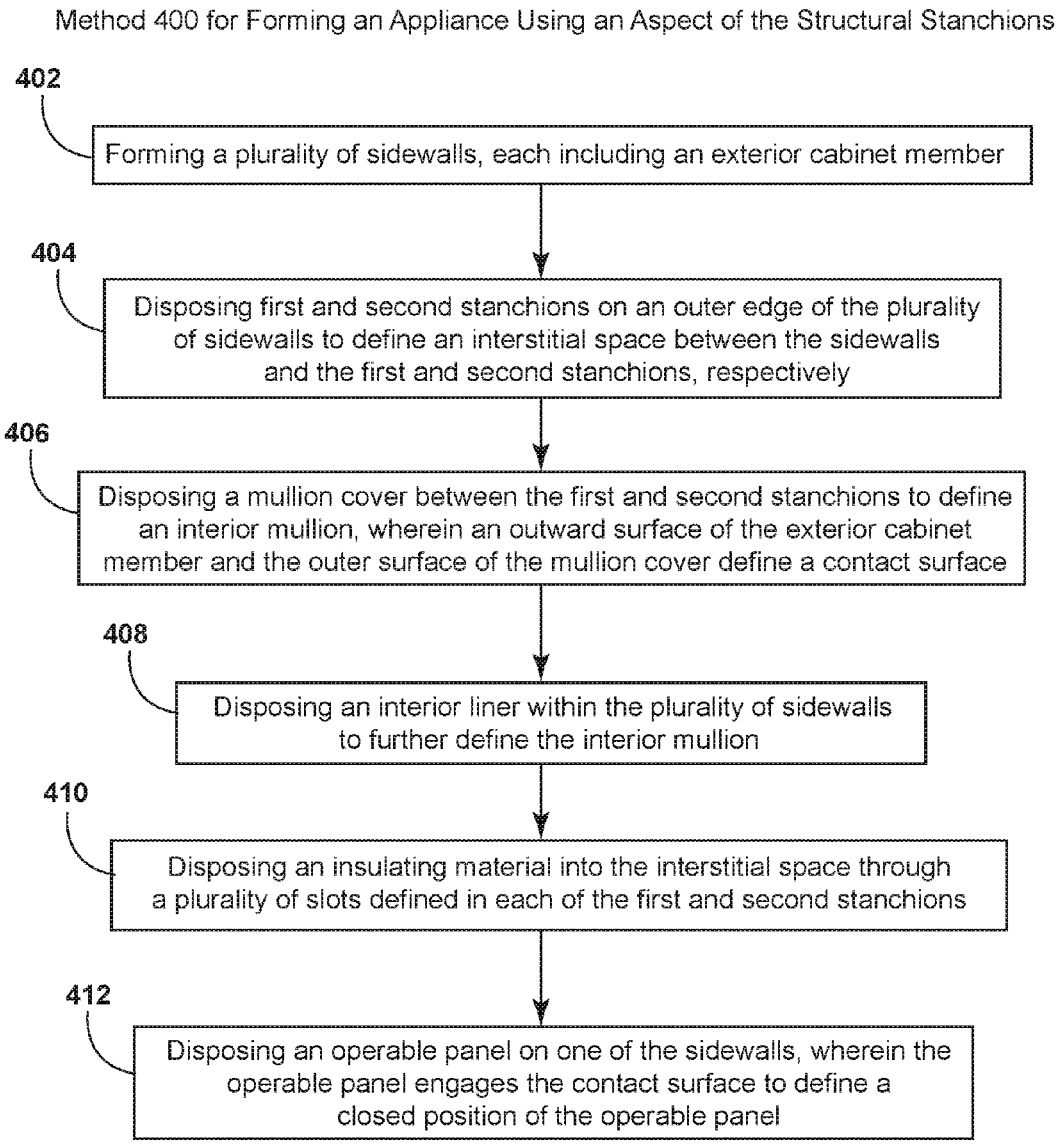
FIG. 15 is a schematic flow diagram illustrating a method for forming a cabinet appliance incorporating an aspect of the structural stanchion.
Figure 16:
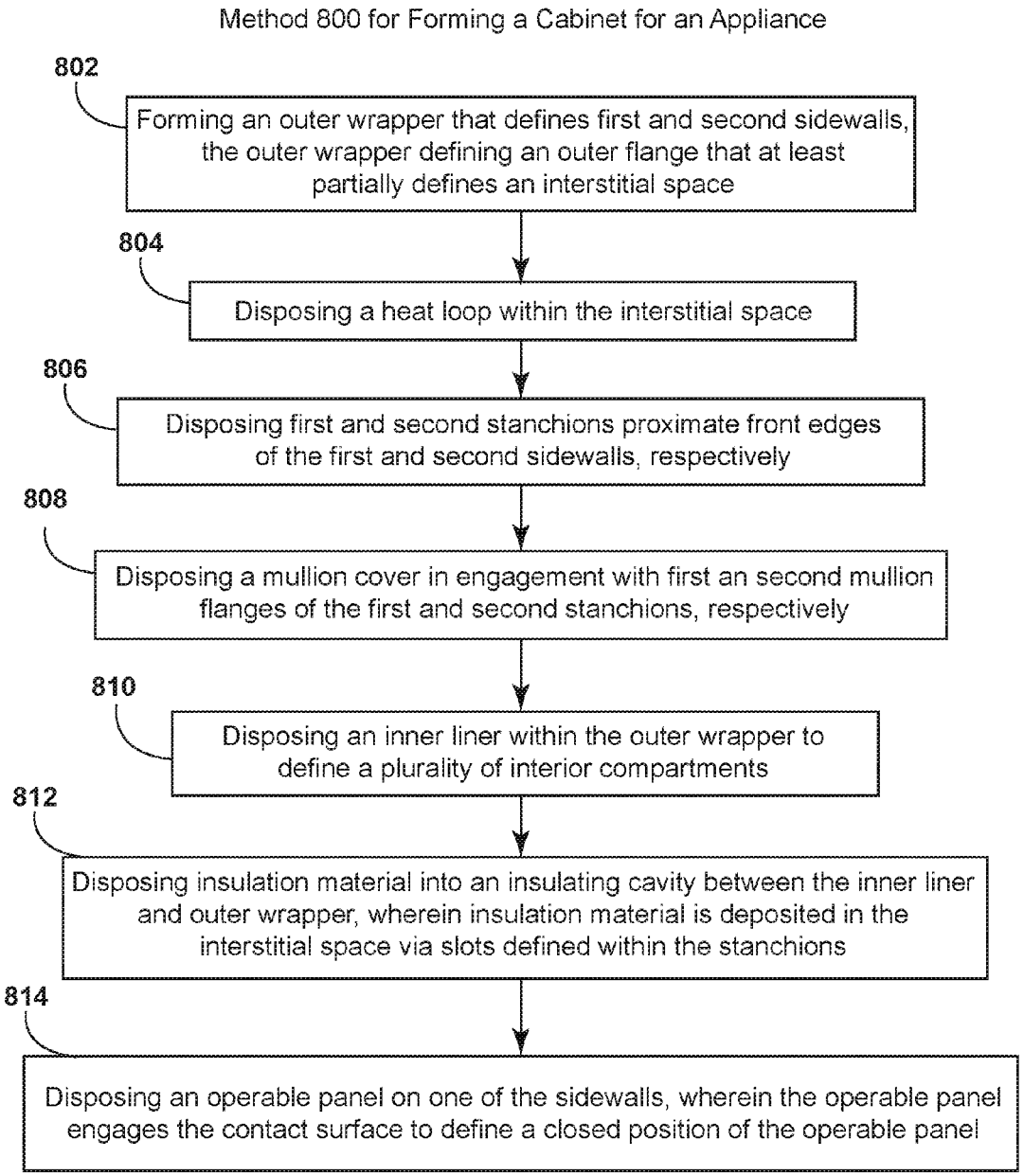
FIG. 16 is a schematic flow diagram illustrating an aspect of a method forming a cabinet appliance incorporating an aspect of the structural stanchion.
Figure 17:
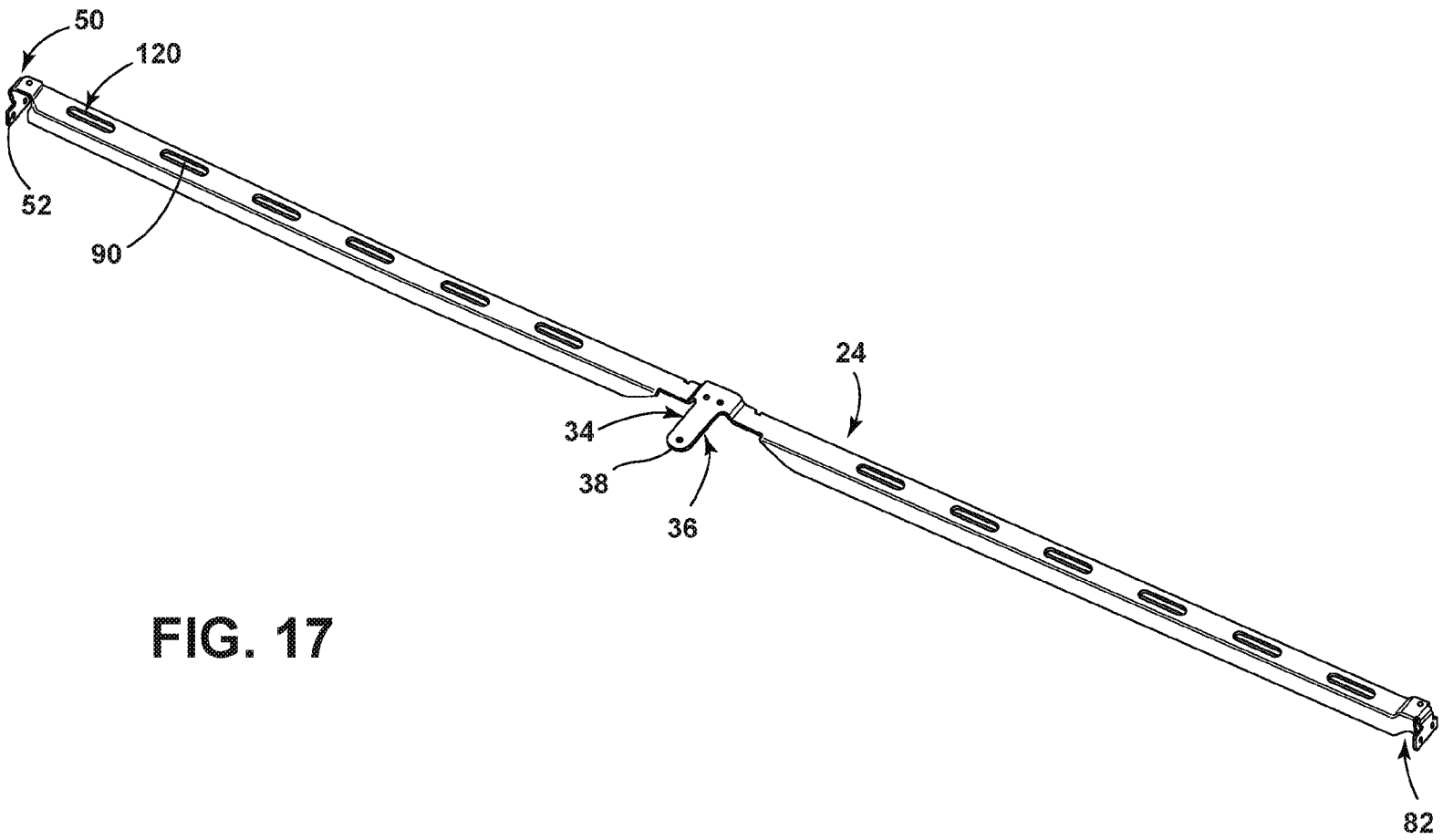
FIG. 17 is a perspective view of an aspect of the structural stanchion.
Figure 18:
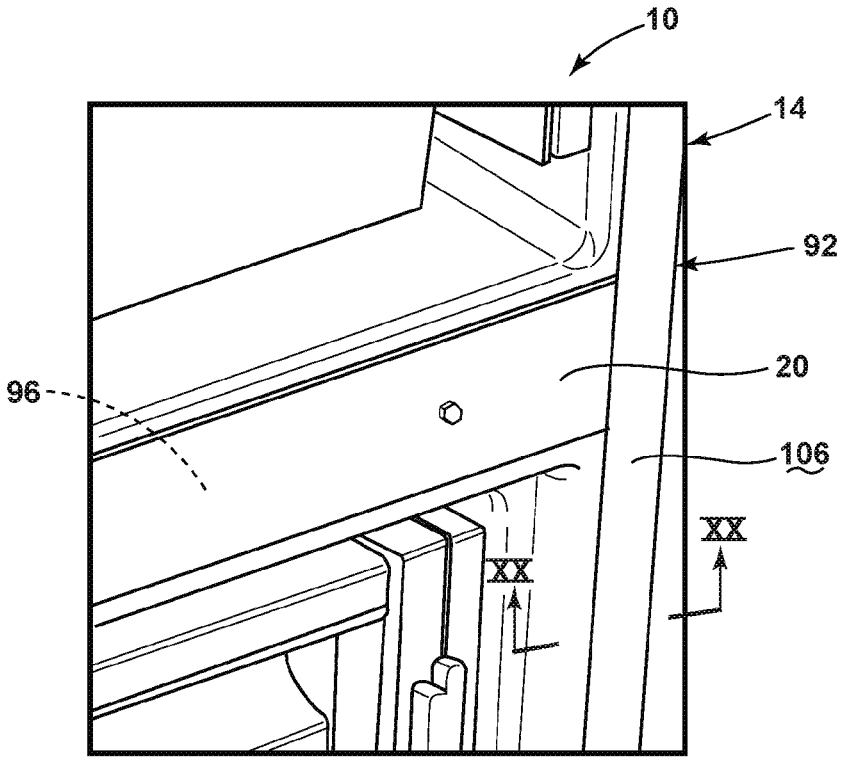
FIG. 18 is a detail perspective view of a cabinet incorporating an aspect of the structural stanchions.
Figure 19:
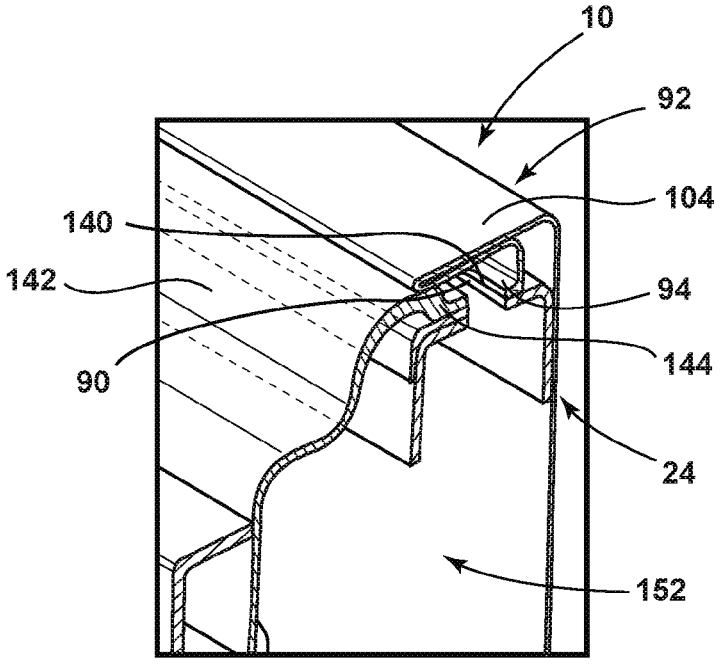
FIG. 19 is a perspective cross-sectional view of various components of the appliance cabinet of FIG. 18 illustrating portions of the interstitial space at least partially defined by aspects of the structural stanchions.
Figure 20:
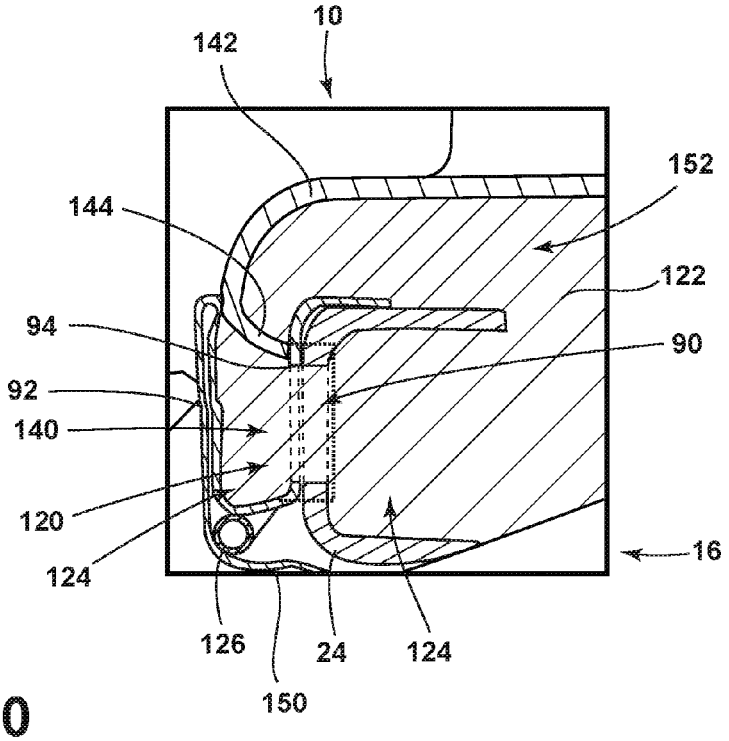
FIG. 20 is a cross-sectional view of the appliance cabinet of FIG. 18 taken along line XX-XX.
Figure 21:
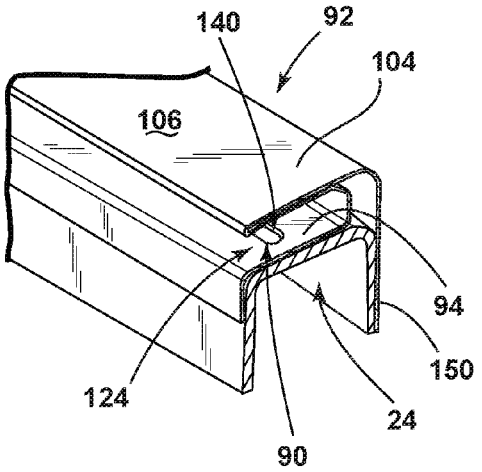
FIG. 21 is a cross-sectional perspective view of an aspect of the structural stanchion and triple flange that define a portion of the interstitial space.
Figure 22:
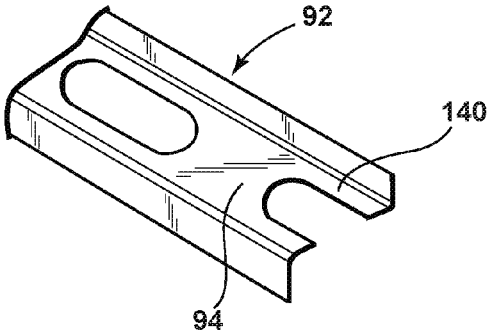
FIG. 22 is a perspective view of an aspect of the triple flange illustrating the flange openings incorporated within the non-visible portion of the triple flange.
Figure 23:
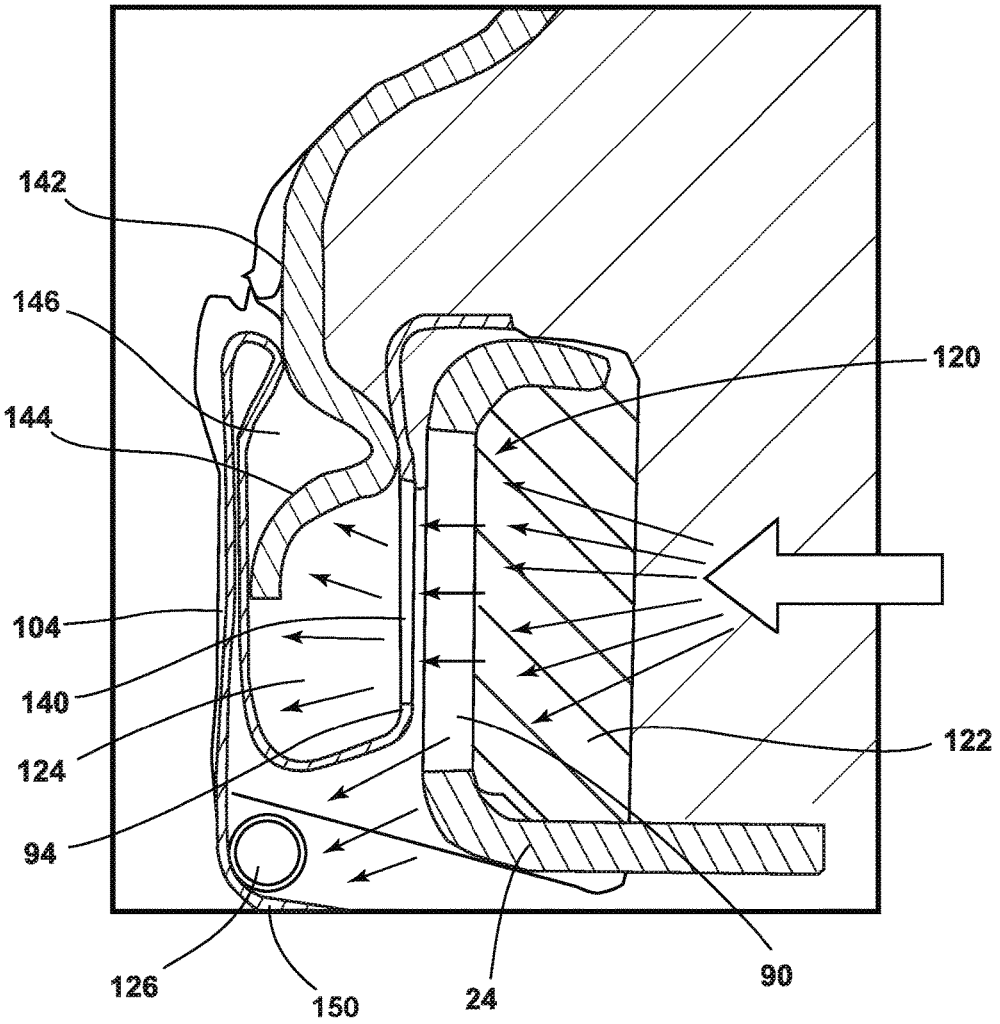
FIG. 23 is a cross-sectional view of an aspect of the interstitial space of the appliance cabinet defined by the structural stanchion and schematically illustrating the flow of insulation throughout the interstitial space.

Referring again to FIGS. 8, 10-14 and 17-23, it is contemplated that the first and second stanchions 24, 26 can include a slot 90 or a plurality of slots 90, where each of the plurality of slots 90 define insulation injection ports 120 through which insulation 122 can be injected into a portion of the appliance 10. It is contemplated that the interstitial space 124 defined between the outer wrapper 150 of the cabinet 14 and the first and second stanchions 24, 26 can receive at least a portion of the insulation 122 that is injected through at least one of the plurality of slots 90 of the first and second stanchions 24, 26. Another portion of the interstitial space 124 can be defined between and around the first and second stanchions 24, 26, the inner liner 142 and the triple flange 92 and/or between the non-visible portion 94 and the outward portion 104 of the triple flange 92. These additional portions of the interstitial space 124 can also receive insulation 122 via the insulation injection ports 120. Additionally, it is contemplated that a heat loop 126 can extend through at least a portion of the interstitial space 124. The heat loop 126 is configured to be in thermal communication with the outer surface 114 of the mullion cover 100, as well as the outward portion 104 of the triple flange 92. In this manner, the heat loop 126 can provide heating that radiates from the heat loop 126 and extends to the contact surface 106 to prevent condensation from forming on the contact surface 106 which may inhibit the operable panels 110 from maintaining the closed position 112. Such condensation can also result in the formation of frost in the interior compartments 22 as well as interfering with the performance of the insulation 122 of the appliance 10. Condensation can be common in conventional appliances (exemplified in FIG. 9) that do not incorporate the insulation injection ports 120 disclosed herein such that insulation is not permitted to fill the interstitial spaces of conventional appliances.

Referring now to FIGS. 17-23, in order to inject the insulation 122 through the insulation injection ports 120 and into the various portions of the interstitial spaces 124, the triple flange 92 can include cooperating flange openings 140 that are spaced to cooperate with the slots 90 of the first and second stanchions 24, 26. The slots 90 can be configured to extend beyond the flange openings 140 that are defined within the non-visible portion 94 of the triple flange 92 as well as beyond the non-visible portion 94. In this manner, the slots 90 are configured to allow for the injection of the insulation 122 through the flange openings 140 and also around portions of the triple flange 92 proximate the heat loop 126 and the outward portion 104 of the triple flange 92. In order to at least partially contain the insulation 122 within the interstitial space 124, a portion of the inner liner 142 can be contoured to engage various portions of the triple flange 92. Accordingly, a contoured portion 144 of the inner liner 142 can be configured to engage the non-visible portion 94 and the outward portion 104 to substantially contain the insulation 122 within the interstitial spaces 124. The contoured portion 144 can also define a liner gap 146 between the contoured portion 144 of the inner liner 142 and a portion of the triple flange 92. In various embodiments, the heat loop 126 can extend through the liner gap 146.

Referring again to FIGS. 10-14 and 20-23, it is contemplated that the heat loop 126 of the appliance 10 can include a mullion loop 130 that extends from proximate one of the first and second stanchions 24, 26 and extends substantially across an entire length of the mullion cover 100. It is contemplated that the heat loop 126 can include a single mullion loop 130 that extends across the length of the mullion cover 100, as well as the length of the interior mullion 20 that is covered by the mullion cover 100.

Referring again to FIGS. 11-14 and 24, it is contemplated that the mullion cover 100 can include at least one support portion proximate the inner surface 98 of the mullion cover 100 that supports a section of the mullion loop 130. It is contemplated that a support portion of the mullion cover 100 can include an upper loop support 132 and a lower loop support 134. In such an embodiment, the upper loop support 132 engages a top section 136 of the mullion loop 130 and the lower loop support 134 engages a bottom section 138 of the mullion loop 130. Through the incorporation of the upper and lower loop supports 132, 134 of the mullion cover 100, the mullion loop 130 is continuously supported by at least a portion of the mullion cover 100, such that the mullion loop 130 can extend entirely across the interior mullion 20 for providing heat to the contact surface 106 proximate the interior mullion 20. It is contemplated that the support portion of the mullion cover 100, including the upper loop support 132 and the lower loop support 134, can be integrally formed as part of the mullion cover 100. The upper and lower loop supports 132, 134 can be formed by wrapping a portion of the mullion cover 100 to form a support channel through which a portion of the heat loop 126 can extend and be retained. Accordingly, the support channel is configured to extend approximately 180°, and typically more than 180°, around a portion of the heat loop 126 extending through the upper or lower loop support 132, 134. Accordingly, the portion of the heat loop 126 can be "snapped" or otherwise held in place within the support channel of the upper and lower loop supports 132, 134 and retained there during manufacture and use of the appliance 10. Accordingly, longer runs of the mullion loop 130 are contemplated over conventional designs where the mullion loop 130 of the mullion loop 130 can extend entirely across the front edge 28 of the interior mullion 20.

Figure 24:
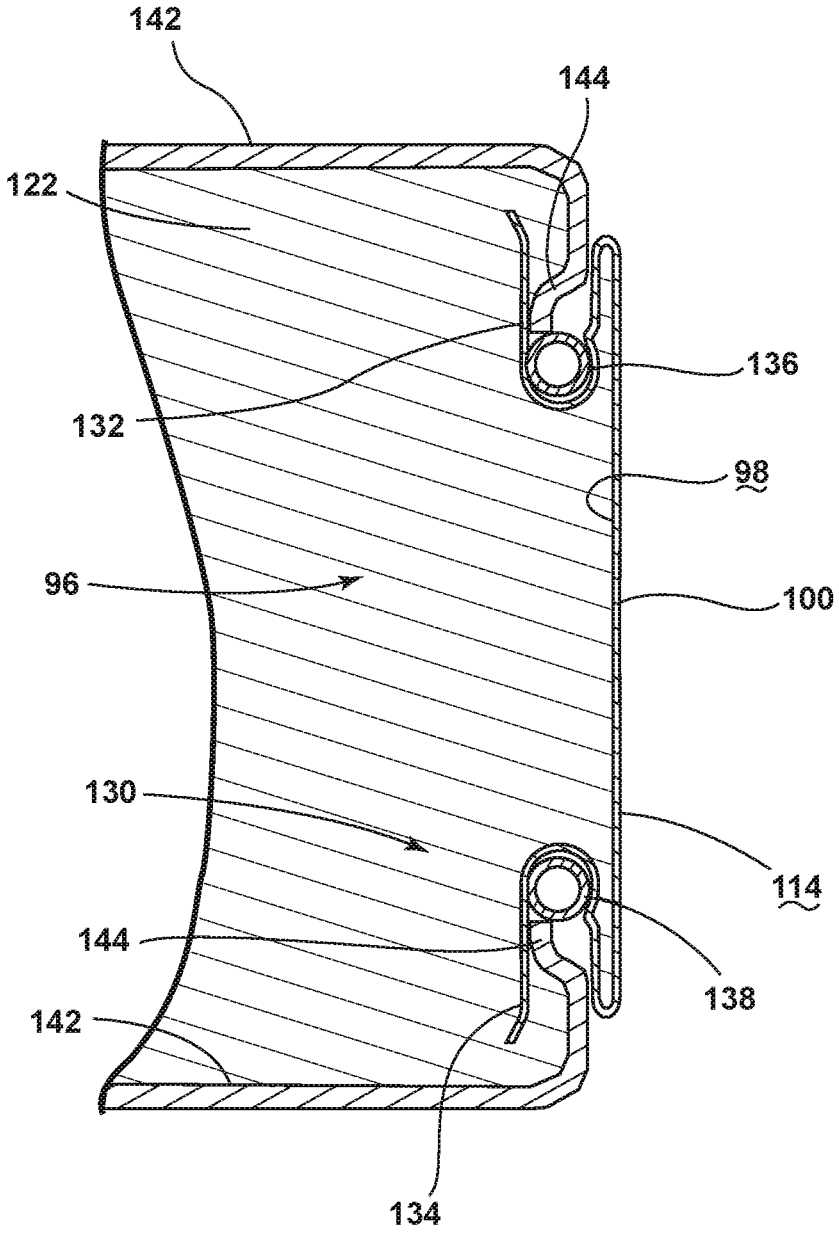
FIG. 24 is a cross-sectional view of an aspect of the mullion cover and the interior mullion of the appliance of FIG. 1 taken along line XXIV-XXIV.

Referring now to FIG. 24, the interior mullion volume 96 of the interior mullion 20 can be filled with insulation 122. In this manner, the various components of the mullion cover 100, in cooperation with the inner liner 142, allow the insulation 122 to be injected throughout the interior mullion 20. The configuration of the mullion cover 100 having the upper and lower loop supports 132, 134 allows the insulation to be injected right up to and in contact with the inner surface 98 of the mullion cover 100. The inner liner 142 at least partially engages the upper and lower loop supports 132, 134 to prevent insulation from engaging and potentially surrounding the top and bottom sections 136, 138 of the mullion loop 130. This configuration maximizes the thermal communication between the mullion loop 130 of the heat loop 126 and the outer surface 114 of the mullion cover 100.

According to the various embodiments, it is contemplated that various appliances 10 can include multiple interior mullions 20. It is contemplated that each interior mullion 20 of the particular appliance 10 can include separate first and second medial flanges 34, 60 that receive portions of hinges for the appliance 10. It is also contemplated that each interior mullion 20 can include a separate mullion cover 100 with upper and lower loop supports 132, 134 for receiving portions of a heat loop 126 that extends proximate a portion of each interior mullion 20 of the appliance 10.

According to the various embodiments, it is contemplated that the heat loop 126 of the appliance 10 can include various heat radiating devices that can include, but are not limited to, a refrigerant line, a fluid line, an electrically conductive wire, combinations thereof, and other similar heat radiating devices that can provide a temperature controlling function to the contact surface 106 of the appliance 10. Accordingly, the contact surface 106 extending along the front surface of the cabinet 14, and which defines various apertures for accessing the plurality of interior compartments 22 can define a defrost state of the contact surface 106 that is initiated through activation of heat. According to the various embodiments, the defrost state is defined by activation of the heat loop 126 and activation of the heat loop 126 tends to generate an increased surface temperature of the contact surface 106 to prevent frost formation and condensation within the contact surface 106.

Referring now to FIGS. 1-8 and 10-15, having described various embodiments of the structural stanchions of the appliance 10, a method 400 is disclosed for forming a cabinet 14 for an appliance 10 that incorporates various aspects of the first and second stanchions 24, 26. According to the method 400, step 402 includes forming a plurality of the sidewalls that includes an exterior cabinet member. After forming the sidewalls, first and second stanchions 24, 26 are disposed proximate front edges 28 of the plurality of sidewalls (step 404). In this manner, interstitial spaces 124 are defined between the first and second stanchions 24, 26 and the plurality of sidewalls. It is contemplated that the first and second stanchions 24, 26 can include at least one slot 90, where each slot 90 defines an insulation injection port 120 through which insulation 122 can be injected into at least a portion of the interstitial space 124.

Referring again to FIGS. 1-8 and 10-15, according to various embodiments, before the insulation 122 is disposed, the triple flange 92, being a shaped portion of the outer wrapper 150, is disposed over at least a portion of the first stanchion 24 and at least a portion of the second stanchion 26 such that the non-visible portions 94 engage the respective first and second stanchions 24, 26. Once the first and second stanchions 24, 26 are positioned, a mullion cover 100 is engaged with the first and second stanchions 24, 26 to define a portion of the interior mullion 20 (step 406). It is contemplated that an outer surface 114 of the mullion cover 100 along with the outward portion 104 of the triple flange 92 defines the contact surface 106 of the appliance 10. Once the mullion cover 100 is in place, the inner liner 142 is disposed within the plurality of sidewalls to further define the interior mullion 20 (step 408).

According to the various embodiments, the heat loop 126 of the appliance 10 can be disposed within at least one of the various interstitial spaces 124 of the appliance 10 between the first and second stanchions 24, 26 and the cabinet 14 of the appliance 10 and within and around the inner liner 142 and the triple flange 92. When the first and second stanchions 24, 26 are disposed on the cabinet 14 to define at least a portion of the interstitial spaces 124, a mullion loop 130 of the heat loop 126 extends from the first stanchion 24 proximate the first medial flange 34 and extends across to the second stanchion 26 proximate the second medial flange 60. At this point, the mullion loop 130 of the heat loop 126 is substantially unsupported. When the mullion cover 100 is disposed over the interior mullion 20, the upper and lower loop supports 132, 134 of the mullion cover 100 engage portions of the mullion loop 130 to provide continuous support to the mullion loop 130 as it extends across the interior mullion 20. Accordingly, the mullion loop 130 can be placed in thermal communication with the contact surface 106 defined by the outer surface 114 of the mullion cover 100 as well as the outward portion 104 of the triple flange 92.

Referring again to FIGS. 1-8 and 10-15, the method 400 includes a step 410 of disposing the insulation 122 within the interstitial space 124 (step 410). The insulation 122 is injected into the insulating cavity 152. This injection process causes the insulation 122 to travel through the insulation injection ports 120 into the interstitial space 124. The insulation injection ports 120 can be further defined by the flange openings 140 in the non-visible portion 94 of the triple flange 92. According to the various embodiments, it is contemplated that the insulation 122 can be injected through each of the slots 90 and the flange openings 140 that define the insulation injection ports 120 such that the insulation 122 can be injected directly into the interstitial spaces 124 and allowed to flow through the area of the interstitial space 124 proximate the particular insulation injection port 120, the triple flange 92, heat loop 126 and the respective first and second stanchions 24, 26. It is contemplated that the first and second stanchions 24, 26 can include a plurality of the slots 90 that define insulation injection ports 120 such that multiple injection locations are defined in the first and second stanchions 24, 26 to allow the insulation 122 to flow into substantially all of the interstitial space 124 of the appliance 10.

Referring again to FIGS. 1-8 and 10-15, after the insulation 122 is disposed within the interstitial space 124, at least one operable panel 110 can be disposed in operable engagement with the plurality of sidewalls (step 410). In this manner, the at least one operable panel 110 selectively engages the contact surface 106 to define a closed position 112 of the at least one operable panel 110. As discussed above, the outer surface 114 of the mullion cover 100 defines a portion of the contact surface 106. According to the various embodiments, the configuration of the first and second stanchions 24, 26 can depend upon the configuration of the appliance 10. An appliance 10 having a single rotationally operable door has a single set of hinges, which typically include only a single medial flange and a single top flange 50 to provide structural support for the hinges of the single operable door. Alternatively, in a French door bottom mount (FDBM) refrigerator, the pair of French doors each include upper and lower hinges and structural support therefor. In such an embodiment, the first and second stanchions 24, 26 will each include respective first and second medial flanges 34, 60 as well as top flanges 50 to provide robust structural support for the first and second hinges 40, 66 as well as the first and second upper hinges 54, 72 to support operation of the pair of French doors.

Referring now to FIGS. 1-8, 10-14 and 16, a method 800 is disclosed for forming a cabinet 14 for an appliance 10. According to the method 800, an outer wrapper 150 at least partially defines the first and second sidewalls 16, 18 of the cabinet 14 (step 802). As discussed herein, the outer flange, typically defined by the triple flange 92, can be integral with the front edge 28 of the first and second sidewalls 16, 18. It is contemplated that the first and second sidewalls 16, 18 can also be at least partially defined by the inner liner 142, as well as the first and second stanchions 24, 26, the triple flange 92 and other various aspects of the cabinet 14. The heat loop 126 can then be disposed within the interstitial space 124 defined by the triple flange 92 (step 804). The first and second stanchions 24, 26 can be disposed on front edges 28 of the first and second sidewalls 16, 18, respectively (step 806). As discussed previously, the first and second stanchions 24, 26 can each include the plurality of slots 90 defined therein. It is contemplated that the first and second stanchions 24, 26 define vertical supports of the first and second sidewalls 16, 18. According to the various embodiments, it is contemplated that the first and second stanchions 24, 26 can extend from the base 30 of the cabinet 14 to the top panel 32 of the cabinet 14 to provide a continuous structural support along the front edge 28 of each of the first and second sidewalls 16, 18 of the cabinet 14.

Referring again to FIGS. 1-8, 10-14 and 16, a mullion cover 100 is then attached to the first and second medial flanges 34, 60 of the first and second stanchions 24, 26, respectively (step 808). It is contemplated that the first and second medial flanges 34, 60 are free of engagement with one another. In this manner, when the mullion cover 100 is attached to the first and second stanchions 24, 26, the primary support of the interior mullion 20, proximate the contact surface 106, is the mullion cover 100 itself. It is contemplated that no additional structural members are included within the interior mullion 20 at a position between the first and second medial flanges 34, 60. The method 800 also includes disposing the inner liner 142 proximate the outer wrapper 150 (step 810). The inner liner 142, when positioned within the outer wrapper 150, defines a plurality of interior compartments 22 within the cabinet 14.

Referring again to FIGS. 1-8, 10-14 and 16, it is contemplated that the outer flange, in the form of either the triple flange 92 or the exterior cabinet member 102, along with the mullion cover 100, defines the contact surface 106 of the cabinet 14. Additionally, the interstitial space 124 is defined between the outer flange and the first and second stanchions 24, 26 and the inner liner 142. In this manner, the first and second sidewalls 16, 18 are formed through the engagement of the outer flange with the first and second stanchions 24, 26 to define the contact surface 106 of the appliance 10. After the contact surface 106 of the cabinet 14 is formed, the heat loop 126 is in thermal communication with the contact surface 106. After the contact surface 106 is formed, insulation 122 can be disposed within an insulating cavity 152 defined between the outer wrapper 150 and the inner liner 142 (step 812). As the insulation 122 fills the insulating cavity 152, a portion of the insulation 122 fills the interstitial space 124 by traveling through the slots 90 of the first and second stanchions 24, 26 and then through the flange openings 140 disposed within the non-visible portion 94 of the triple flange 92. In this manner, the insulation 122 can be conveniently injected into the interstitial space 124 to provide sufficient and continuous insulation 122 throughout most, if not all, of the first and second sidewalls 16, 18. After the insulation 122 is deposited within the insulating cavity 152 and the interstitial space 124, the cabinet 14 is prepared to receive at least one operable panel 110 in operable engagement with at least one of the first and second sidewalls 16, 18 (step 814). The operable panel 110 is configured to selectively engage the contact surface 106 to define the closed position 112 of the operable panel 110. It is also contemplated that the outer surface 114 of the mullion cover 100 further defines a portion of the contact surface 106. As discussed previously, the number of operable panels 110 attached to the cabinet 14 can vary. Additionally, depending upon the number of operable panels 110, the number of hinges that require support from the first and second stanchions 24, 26 can also vary depending upon the design of the appliance 10.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. An appliance comprising:

a cabinet having first and second sidewalls and an interior mullion extending therebetween, wherein the first and second sidewalls and the interior mullion define a plurality of interior compartments;

first and second stanchions that define vertical structural members of the first and second sidewalls, respectively, wherein the first stanchion includes a first medial flange that extends partially into the interior mullion, wherein the first medial flange defines a first hinge attachment point, and wherein a distal end of the first medial flange is positioned proximate a first hinge, and wherein the first medial flange is integrally formed with the first stanchion and is free of direct contact with the second stanchion; and an exterior cabinet member that extends over at least a portion of the first stanchion and at least a portion of the second stanchion, wherein an outward portion of the exterior cabinet member includes a contact surface, wherein a heat loop is at least partially disposed in an interstitial space defined by a folded portion of the exterior cabinet member, the heat loop being in thermal communication with the contact surface, and wherein the first and second stanchions and the folded portion of the exterior cabinet member cooperatively define a plurality of slots wherein each of the plurality of slots define insulation injection ports through which insulation is injected into at least a portion of the interstitial space, wherein the slots of the folded portion are aligned with the slots of the first and second stanchions.

2. The appliance of claim 1, wherein the first and second stanchions include top flanges that engage a top panel of the cabinet, wherein the top flange of the first stanchion defines a first upper hinge support that supports a first upper hinge, wherein the first upper hinge is vertically aligned with the first hinge and the first hinge attachment point.

3. The appliance of claim 1, further comprising:

a second medial flange of the second stanchion, wherein the second medial flange extends partially into the interior mullion, wherein the second medial flange defines a second hinge attachment point, and wherein an outer end of the second medial flange is positioned proximate a second hinge, and wherein the distal end of the first medial flange is free of direct engagement with the outer end of the second medial flange.

4. The appliance of claim 3, wherein the first and second medial flanges are integral with the first and second stanchions, respectively.

5. The appliance of claim 3, wherein the cabinet includes a mullion cover that extends between the first and second stanchions, and wherein the mullion cover directly engages and conceals the first and second medial flanges, wherein the mullion cover is free of interior structural members between the first and second medial flanges.

6. The appliance of claim 1, wherein the first and second stanchions extend from a base of the cabinet to a top panel of the cabinet, wherein a leveling mechanism of the cabinet is disposed proximate the base at bottom ends of the first and second stanchions.

7. The appliance of claim 1, further comprising:

at least one operable panel that selectively engages the contact surface to define a closed position of the at least one operable panel, wherein an outer surface of a mullion cover of the interior mullion defines a portion of the contact surface.

8. An appliance comprising:

a first sidewall having a first hinge attached to a first stanchion;

a second sidewall having a second hinge attached to a second stanchion;

an interior mullion extending between the first and second stanchions, wherein first and second medial flanges of the first and second stanchions, respectively, extend into the interior mullion and support the first and second hinges;

a mullion cover extending along the interior mullion between the first and second medial flanges;

a heat loop that is in thermal communication with an outer surface of the mullion cover; and an exterior cabinet member that extends over at least a portion of the first stanchion and at least a portion of the second stanchion, wherein an outward portion of the exterior cabinet member includes a contact surface, wherein the heat loop is in thermal communication with the contact surface, wherein the first and second medial flanges engage an inner surface of the mullion cover and are positioned at the contact surface, and wherein the first and second stanchions are offset from the contact surface to define an interstitial space within a folded, portion of the exterior cabinet member, wherein:

the mullion cover conceals the first and second medial flanges from view;

the first and second medial flanges extend to respective distal ends, wherein the distal ends terminate at the first and second hinges, respectively, and wherein the first and second medial flanges are laterally offset from the respective first and second stanchions and are free of direct engagement with one another and with an interior liner of the first and second sidewalls; and the mullion cover is free of direct interior structural reinforcement members between the distal ends of the first and second medial flanges.

9. The appliance of claim 8, wherein the interior mullion includes an interior mullion volume that is defined by the mullion cover, and wherein the interior mullion volume is at least partially filled with insulation that at least partially engages an inner surface of the mullion cover.

10. The appliance of claim 9, wherein the heat loop extends through at least a portion of the interior mullion volume.

11. The appliance of claim 10, further comprising:

at least one operable panel that selectively engages the contact surface to define a closed position of the at least one operable panel, wherein the outer surface of the mullion cover defines a portion of the contact surface.

12. The appliance of claim 10, wherein the heat loop includes a mullion loop that extends from proximate one of the first and second stanchions and extends substantially across a length of the mullion cover proximate the inner surface of the mullion cover.

13. The appliance of claim 10, wherein the heat loop includes a single mullion loop.

14. The appliance of claim 12, wherein the mullion cover includes a support portion that supports a section of the mullion loop.

15. The appliance of claim 14, wherein the support portion includes an upper loop support and a lower loop support, wherein the upper loop support engages a top section of the mullion loop and wherein the lower loop support engages a bottom section of the mullion loop.

16. The appliance of claim 14, wherein the support portion is integrally formed with the mullion cover.

* * * * *